US006205686B1

(12) United States Patent
Davis

(10) Patent No.: US 6,205,686 B1
(45) Date of Patent: Mar. 27, 2001

(54) FOOTWEAR ATTACHMENT

(76) Inventor: Merwyn C. Davis, 611 Windspirit, Prescott, AZ (US) 86303

( * ) Notice: Subject to any disclaimer, the term of this patent is extended or adjusted under 35 U.S.C. 154(b) by 0 days.

(21) Appl. No.: 09/359,623

(22) Filed: Jul. 22, 1999

(51) Int. Cl.[7] ..... A43B 11/00
(52) U.S. Cl. ..... 36/138; 36/136
(58) Field of Search ..... 36/136, 138, 132

(56) References Cited

U.S. PATENT DOCUMENTS

| | | | | |
|---|---|---|---|---|
| 35,448 | * | 6/1862 | Hudson | 36/1 |
| 45,776 | * | 1/1865 | Watson | 36/138 |
| 384,155 | * | 6/1888 | Hathorn | 36/138 |
| 404,449 | * | 6/1889 | Vail | 36/138 |
| 527,717 | * | 10/1894 | Pendergast | 36/138 |
| 588,156 | * | 8/1897 | Lewis | 36/1 |
| 1,342,149 | * | 6/1920 | Avis | 36/1 |
| 2,619,744 | * | 12/1952 | Mattes | 36/138 |
| 3,621,592 | * | 11/1971 | Goldmerstein | 36/138 |
| 5,090,140 | * | 2/1992 | Sessa | 36/138 |

* cited by examiner

*Primary Examiner*—Paul T. Sewell
*Assistant Examiner*—Jila Mohandesi
(74) *Attorney, Agent, or Firm*—Gregory J. Nelson

(57) ABSTRACT

An attachment to footwear, particularly boots, to assist in their removal from the foot of the wearer. The attachment comprises a strap hinged to the heel of the footwear. Fasteners secure the strap against the heel extending generally vertically upward in a stored position. In use, the strap is loosened and placed on the surface so the wearer may place weight on the strap to anchor the footwear so the wearer's foot may be withdrawn. The strap may have decorative features and define an opening to accommodate a spur. In another embodiment, the attachment comprises a spring steel wire bail to which the strap is hinged. The bail may be detachably secured to the footwear in the welt in the heel area by an elastic band.

6 Claims, 4 Drawing Sheets

FIG. 1.
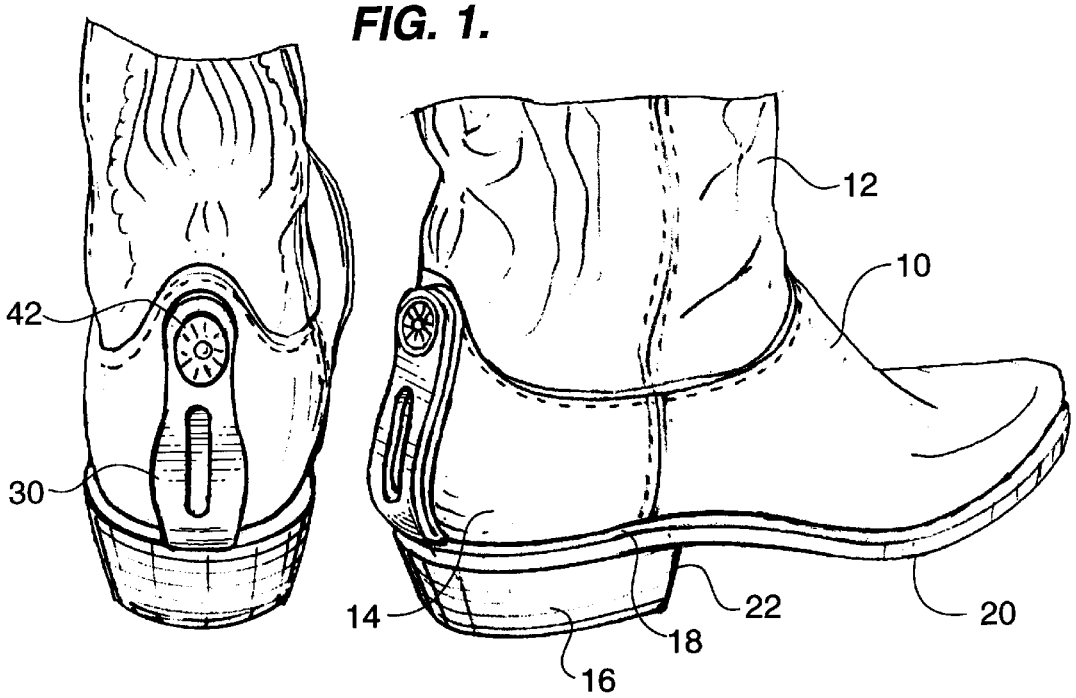
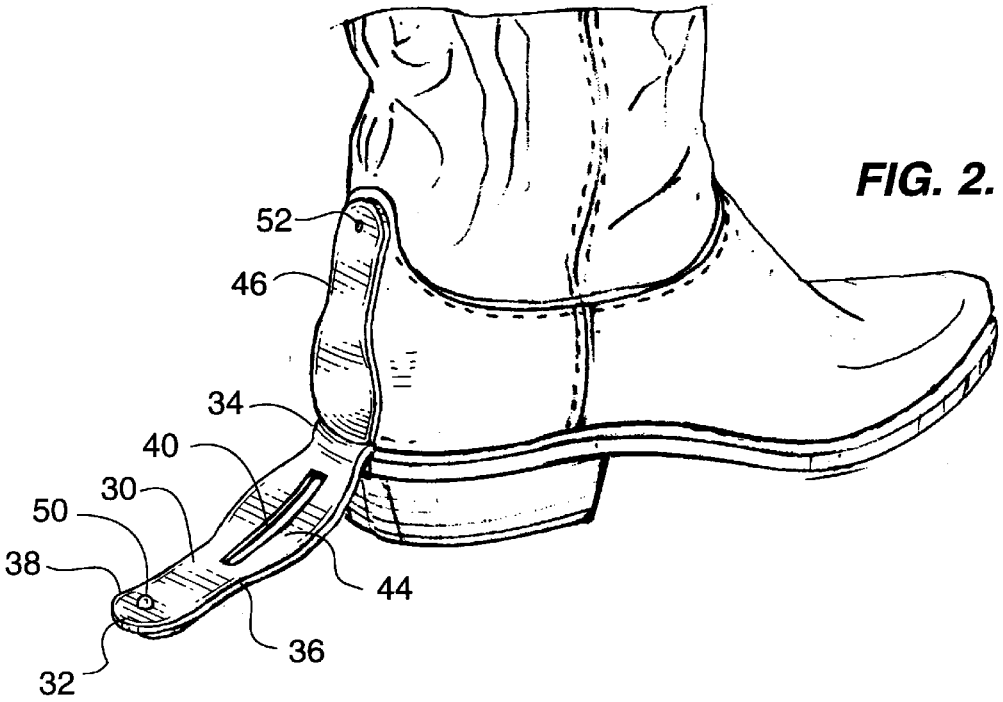
FIG. 2.

FOOTWEAR ATTACHMENT

FIELD OF THE INVENTION

The present invention relates to an attachment to be applied to footwear and more particularly relates to a footwear accessory attachment including a strap which may be used to assist the wearer in removing the footwear from the wearer's foot.

BACKGROUND OF THE INVENTION

Removal of certain types of footwear such as cowboy style and work boots from the wearer's foot is often difficult because of their snug fit. In some instances, the wearer must enlist the assistance of another individual to pull the boot from the wearer's foot. If assistance is not available, individuals often remove boots or shoes by applying a downward force on the heel of one shoe or boot with the foot of the other to allow the user to withdraw the foot from the shoe or boot. The procedure is then repeated to remove the foot from the boot. While this procedure is effective, it is difficult as the heel area of most boots or shoes present a very small edge or surface against which the downward pressure can be applied.

Another approach to the removal of boots is the use of a boot jack which is an implement consisting of an inclined ramp or platform having a generally U-shaped recess or cut-out at one end of the ramp. The boot wearer inserts the heel of the boot to be removed in the U-shaped recess and applies a downward force on the lower end of the ramp. The recess is intended to grip the heel area and the wearer can then attempt to withdraw the foot from the boot engaged in the boot jack as the boot jack is held in place with the other foot. The boot jack design, while helpful is not always effective since the boot may slip from the recess as the foot is attempted to be withdrawn. Further, a problem with the boot jack is that the jack will often scuff or damage the heel area of the boots.

In attempts to improve over boot jacks and to provide an effective means of removing footwear, several early patents suggest attachments affixed to the heel of the boot.

U.S. Pat. No. 45,776 shows a metallic plate constructed so that it may be attached by screws to the sides of the boot heel. The attachment provides a projection against which downward force can be applied to assist in use as a boot drawer. The device will also assist to support a spur from slipping downwardly.

U.S. Pat. No. 289,525 entitled "Boot" shows a plate which is securable between the heel and sole and projects to the rear of the boot to form a catch for removing the boot.

More recently, U.S. Pat. No. 4,450,634 describes a quick release device for footwear. The release enables one to extract a foot from the footwear. The footwear includes a notch in the toe portion and a projection extending generally upwardly from the heel portion. Removal of footwear is accomplished when the wearer engages the notch in top with the projection in the heel which enables the wearer to extract the foot. With this device, it is necessary only to partially withdraw the foot from the footwear so that the operation can be reversed to extract the other foot from the footwear.

Several early patents also show various straps in connection with footwear, fixed to the heel of footwear such as felt boots to assist in removing the felt boot or liner from outer footwear such as an over-shoe or boot. U.S. Pat. No. 384,155 shows a felt boot with a strap or loop attached to the rear of the boot having a lower free end which forms a loop. When the wearer wishes to remove the boot, the free end of the strap is pulled out of its pocket or receptacle to enable the user to insert a finger or thumb in the loop and remove the felt boot.

Similarly, U.S. Pat. No. 404,449 shows a strap attached to the rear of a felt boot which is maintained in position by an elastic band. To remove the felt boot, the strap is removed from beneath the elastic band. The other foot can then be placed on the strap holding the boot on the ground while the foot is withdrawn.

In spite of the numerous devices to assist users in removing footwear, particularly boots such as work boots and cowboy boots, there nevertheless exists a need for an attachment which may be easily installed by the manufacturer or as an accessory to an existing boot by a shoemaker which would be effective, ornamental and will also serve to protect the boot from wear in the heel area.

SUMMARY OF THE INVENTION

Briefly, the present invention in the preferred embodiment provides a footwear attachment or accessory having a strap with one end affixed at the juncture of the upper surface of the heel and the lower extremity of the counter. The strap is securable in a non-use position along the counter by a fastener which may be a snap fastener, a loop and hook fabric fastener or both. In another embodiment, the lower end of the strap is secured to a hinge. The hinge may be permanently secured to the heel of the boot or temporarily secured by a wire extending along a welt at the lower end of the counter. A band extends between the ends of the loop or spring steel across the juncture of the forward edge of the heel and the sole.

The strap may be provided with a vertically extending slot through which a boot accessory such as a spur may be extended to accommodate to spur and to support the spur in an elevated position. The strap also serves to protect the counter from scuffing as for example when the wearer is engaged in activities such as roping or driving a vehicle.

BRIEF DESCRIPTION OF THE DRAWINGS

The above and other objects and advantages of the present invention will be better understood from the following description, claims and drawings in which:

FIG. 1 is a rear view of a pair of western-style boots showing the footwear attachment of the present invention in a stored position against the boot counter;

FIG. 2 is a side view of one of the boots shown in FIG. 1 with the attachment strap shown in the disengaged position;

DETAILED DESCRIPTION OF THE DRAWINGS

Figure 3:
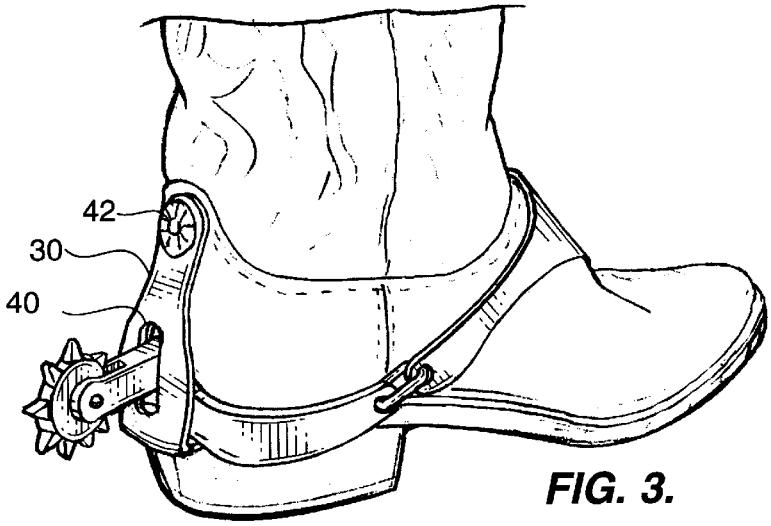
FIG. 3 is a side view of one of the boots and attachments shown in FIG. 1 with the strap in the stored position and used in connection with a spur.
Figure 4:
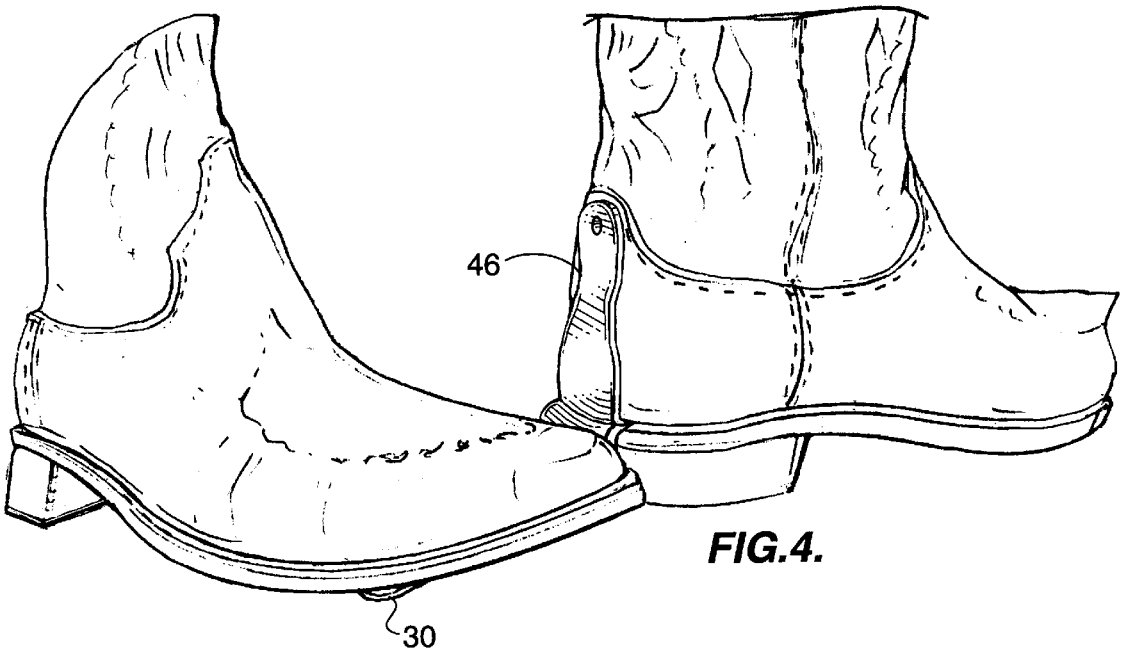
FIG. 4 illustrates the use of the attachment of the present invention in a position to assist in removing footwear.

Turning now to the drawings, particularly FIGS. 1 to 3, the footwear attachment of the present invention is shown in conjunction with footwear 10. Footwear 10 is shown as being a western-style boot having an upper portion 12, a counter 14 and a heel 16. The outside counter 14 and the heel 16 are joined in welt area 18. A shank area 20 extends forwardly of the forward edge 22 of the heel. The boot shown in FIG. 1 is representative or exemplary of various types of footwear to which the invention can be applied. Accordingly, while a western-style boot is shown, it should be understood that the invention may be used in conjunction with other types of footwear such as over boots, work boots, and the like. Further, while the FIG. 1 shows only a single boot, it will be understood that the footwear accessory of the present invention would be applied to both the right and left boot.

The accessory of the present invention comprises a strap 30 which may be of any suitable material such as leather, vinyl or the like. The strap 30 has an upper or distal end 32 and a lower or proximal end 34. The strap 30 may be in the form of an elongate strip or may be more ornamental having a curved side 36 and a rounded upper end 38 as shown. A generally vertically extending slot or opening 40 is provided to accommodate spurs as will be explained with reference to FIG. 3. The strap of the present invention can therefore be used with footwear either with or without such items as spurs.

The outer surface of the strap may be embossed or provided with other decorations or ornamentation such as a design or initial of the boot owner or a brand identification of the boot manufacturer. A concho 42 is shown applied to the exterior surface of the strap.

The inner surface 44 of the strap is substantially entirely covered with one component of a loop and hook fastener material. A mating component 46 of loop and hook fastener material extends vertically from the welt upwardly along the rear portion of the outside counter having a length substantially equal to the overall length of the strap 30. Normally the strap will be about 3" to 6" long. The lower end 34 of the strap 30 is secured to the heel 16 by interposing a portion of the lower end of the strap between the upper laminates of the heel 16. This can be done by a shoemaker or may be installed by the boot manufacturer.

In addition to the fabric loop and hook fasteners, it may be desirable to provide snap fastener component 50 at the upper end of the strap and near the upper end of the fabric strip and a matching component 52 on the rear of the boot to further assist in securing the strap snugly against the rear of the boot when not in use.

In the normal stored or non-use position as shown in FIG. 1, the strap 30 is maintained secured to the rear of the boot along substantially its entire length by the fastener components so that dirt and debris does not collect between the strap and the counter of the boot. Further, by providing substantially full length attachment of strap 30, the possibility of the strap becoming caught or snagged is minimized.

It will also be appreciated that the strap 30 serves to protect the counter area at the rear of the boot. It is well known that footwear may be scuffed when the wearer is engaged in activities such as roping as the boot heels are often dug into the ground. Also, driving of a vehicle will often cause scuffing and abrasion to the heel area of the foot that is applied to the accelerator of the vehicle. The strap 30 will serve to protect the boot from scuffing in these as well as other situations where the rear of the boot is exposed to possible abrasion.

FIG. 2 illustrates use of the footwear attachment of the present invention to assist the wearer in removing a boot. To facilitate removal of a boot, the strap 30 is detached from the rear of the boot by manually separating the fastener components by exerting a pulling force to the end 32. The strap 30 is then allowed to pivot to the position shown in FIG. 2 in which it is at least partially laying on the floor surface. The user may then place the other foot on the upwardly facing inner surface 44 of the strap 30 which will secure the strap and maintain the heel of the boot to be removed on the floor. The user may then withdraw the foot from the boot as it is held by the strap and the force exerted by the user's other foot or boot. Once one of the boots, as for example the left boot, has been removed, the user may remove his or her foot from the other foot simply by detaching the strap and placing the removed foot on the strap.

Once the boots have been removed, the straps will be returned to their normal, stored position shown in FIG. 1 with the fastener components 46, 44 and 50, 52 engaged to maintain the straps snugly against the rear counter.

FIG. 3 shows the strap 30 in a position affixed to the rear of the boot with the vertically extending slot 40 accommodating spurs "S". The strap 30 not only allows the wearer to attach spurs to the boots without interference but will also assist in maintaining the spurs in an elevated position as the lower end of the slot 40 will engage the shank of the spur not allowing it to drop to a position in which it engages the walking surface.

Figure 5:
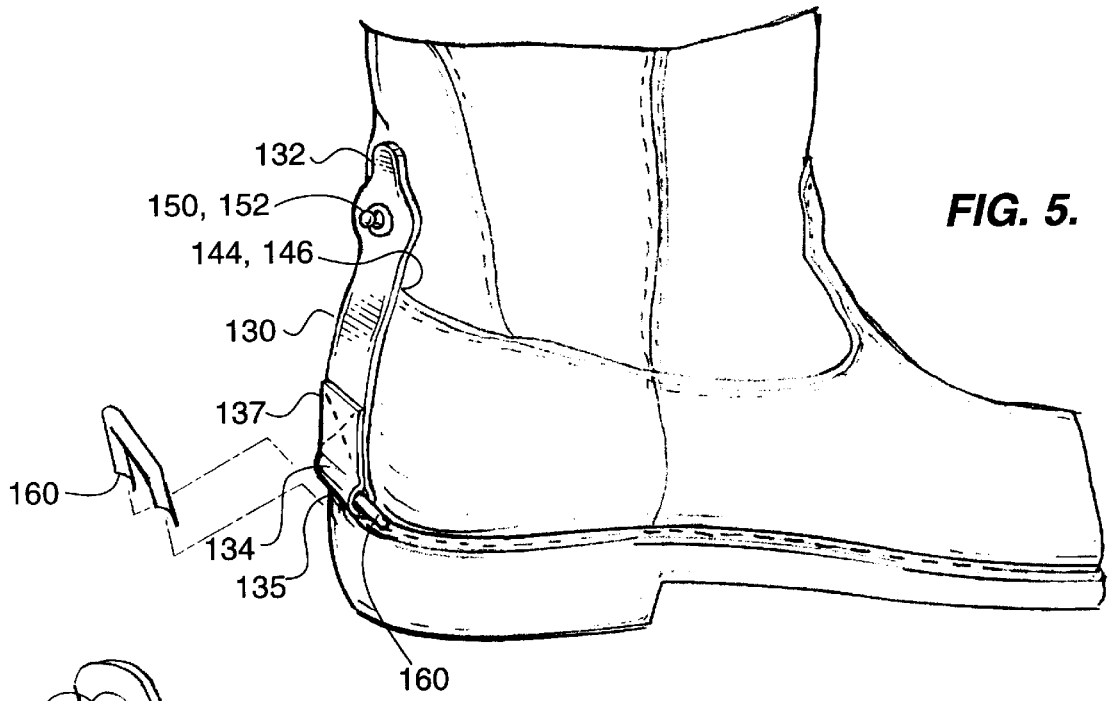
FIG. 5 shows an alternate embodiment of the present invention in connection with a work boot.

FIG. 5 shows an alternate embodiment of the present invention generally designated by the numeral 100 in which the strap 130 is again attached to the rear of footwear 110 which is shown as a work-style boot rather than a western boot. The strap 130 may be leather or other material and has an upper distal end 132 and a lower end 134 which is formed having a loop 135 as a portion of the lower end is reversely folded and stitched at 137. Mating fabric fastener components 144, 146 may be applied to the interior surface of the strap and to the rear surface of the counter of the boot as has been described above. The upper end 132 of the strap 130 carries a snap fastener component 150 which is detachably engageable with a mating component 152 on the rear of the boot. To allow the strap 130 to be pivoted between the stored position shown in FIG. 5 and a use-position in which it extends along the walking surface, a hinge 160 is attached to the rear of the boot in the welt area. The hinge 160 is shown as a wire loop and can be secured by a metal plate or tab secured to the heel by adhesives, fasteners either by the shoe manufacturer or by a shoemaker as a retrofit item. In other respects, the embodiment of FIG. 5 operates in a manner as has been described above.

Figure 6:
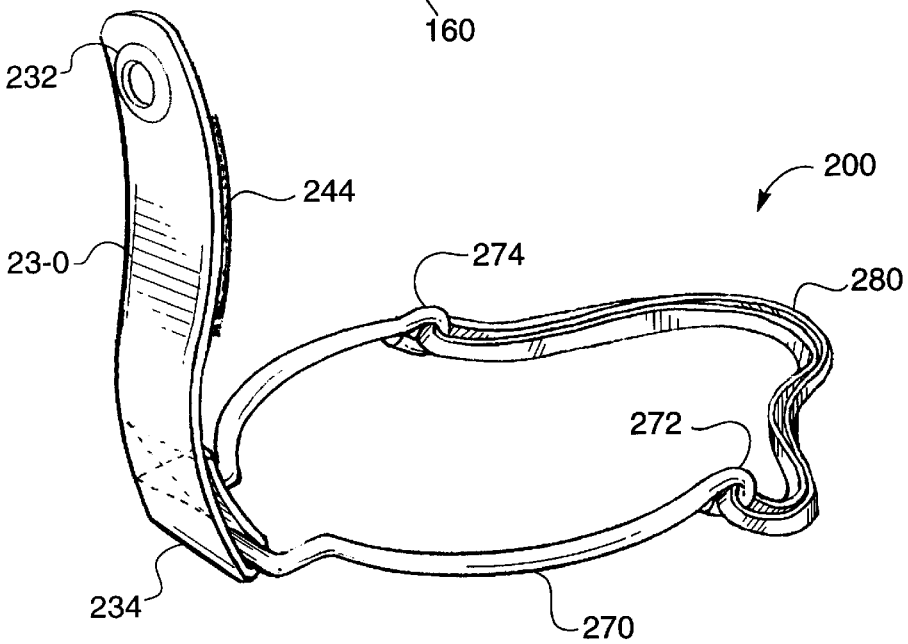
FIG. 6 is a perspective view of an alternate embodiment of the present invention.
Figure 7:
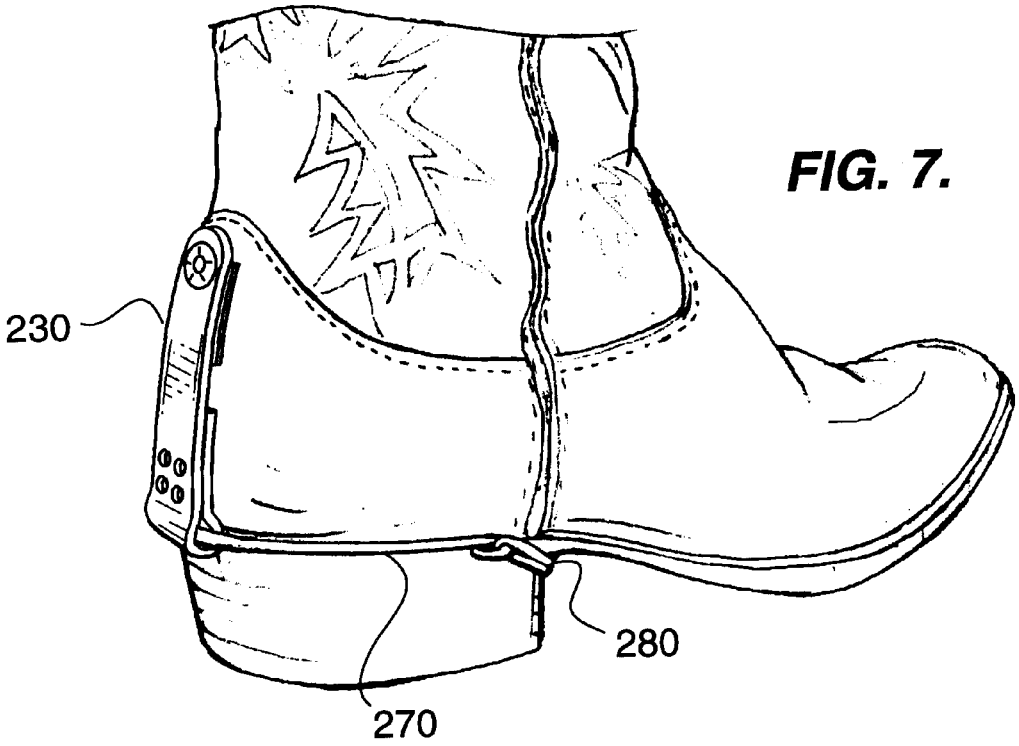
FIG. 7 is a side view of a western boot showing the embodiment of the footwear attachment of FIG. 6 in a stored position.
Figure 8:
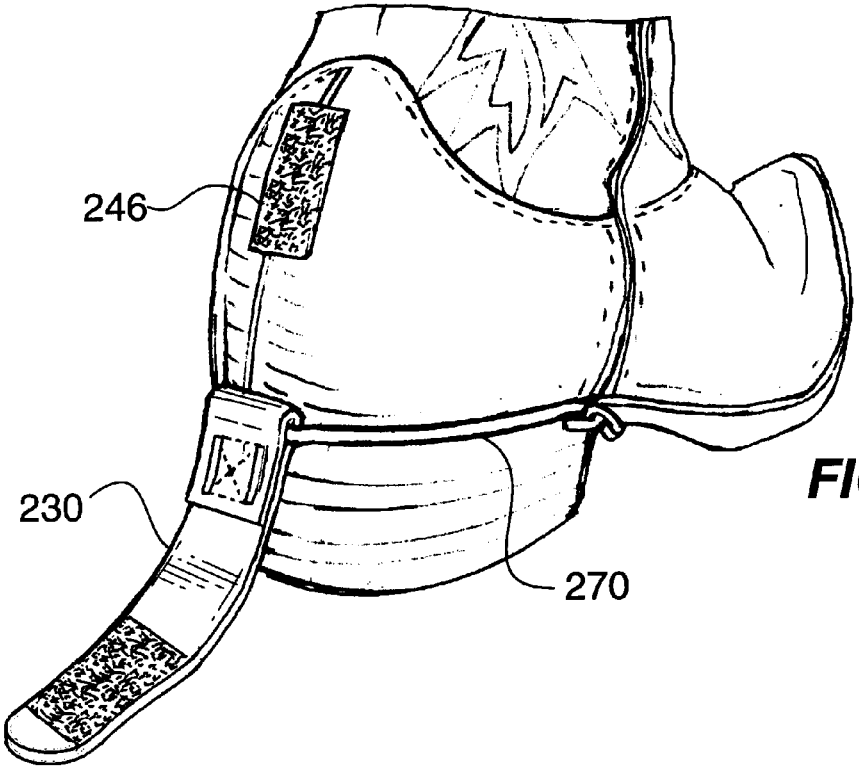
FIG. 8 is a view similar to FIG. 7 with the footwear attachment shown detached in a use-position allowing the user to place his or her weight on the attachment to assist in removing the footwear.

FIGS. 6 to 8 show yet another embodiment of the present invention generally designated by the numeral 200. The embodiments previously described with reference to FIGS. 1 to 5 incorporate a strap that is permanently affixed to the footwear. With the present embodiment, the accessory is detachable and may be easily attached or detached by the user without the requirement of installation either by the boot manufacturer or by a shoemaker. In embodiment 200, the strap 230 is generally as described above and may be in the form of a strip of leather which may have some ornamental configuration thereon. The strap 230 extends from the upper or distal end 232 to a loop 234 at its lower end. The inner surface of the strap is provided with one component 244 of a loop and hook fastener. A cooperating section of fabric fastener material 246 is applied to the rear counter of the boot extending vertically from the heel to a location coextensive with the upper end 232 of the strap 230. The fabric fastener material 246 may be provided to the user with an adhesive covered by a release material so that the user may easily apply the strip to the rear of the boot.

The strap 236 is secured to the boot by means of a semi-circular bail 270 which is configured to snugly be received in the welt area between the outer counter and the heel. The bail is preferably a spring steel having a diameter of approximately ⅛". The rear of the bail 276 is provided with a hinge 272 which receives the loop 234 at the lower or proximal end of the strap. The opposite ends of the wire bail each form an eyelet which may be integrally formed by reversely bending the distal portions of the bail. The eyelets 272, 274 are positionable in the welt area immediately adjacent the forward end 222 of the heel of the boot 210. An elastic band 280 is attached to the eyelets 272, 274 and extends transversely across the shank of the boot at the forward end of the heel. In this way, the bail is snugly secured to the boot and the strap 230 may be positioned as shown in FIG. 7 in a stored position or detached and allowed to assume a use-position shown in FIG. 8 to assist the user in removing the boot.

If the user does not wish to have the accessory attached to the boot at all times, it is an easy matter to slip it off by disengaging the elastic band or by pulling the bail rearwardly, stretching the band to provide sufficient clearance to disengage the band by slipping it downwardly over the heel. It is also relatively easy to re-attach the boot accessory by simply re-positioning it on the boot which is accommodated by the shape of the bail and the elastic band or retainer.

It will be appreciated from the foregoing that the footwear accessory of the present invention provides the wearer a convenient way of removing otherwise hard to remove footwear which does not require the wearer to use his or her hands to remove the footwear. All that is required is that the strap attached to the counter be detached so that it will anchor the boot once weight is applied. The accessory is inexpensive in construction and can be used with various types of footwear. The footwear attachment may be provided as a part of the boot by the manufacturer, or later installed by a shoemaker. In one embodiment, the footwear accessory may be attached and detached from the boot as required by the boot wearer.

It will be obvious to those skilled in the art to make various changes, alterations and modifications to the invention described herein. To the extent such changes, alterations and modifications do not depart from the spirit and scope of the appended claims. They are intended to be encompassed therein.

I claim:

1. Footwear of the type having a sole, a heel and a closed outside counter to assist the wearer in removing the footwear from the wearer's foot and to protect the heel from scuffing, said footwear comprising:

(a) a strap having opposite upper and lower ends, opposite sides and opposite inner and outer surfaces;

(b) a wire loop secured intermediate the heel and counter for hingedly securing the lower end of said strap to the heel area of the footwear;

(c) cooperating loop and hook fastener means on said footwear and on said strap extending substantially over the entire inner surface of the strap; and (d) said strap having sufficient length so as to have a stored position extending upwardly along the rear of the boot when said fastener means are engaged and a use-position extending rearwardly of the heel onto a supporting surface to enable a person to place weight on the strap to anchor the footwear on the surface while the person withdraws his or her foot from the footwear.

2. The footwear of claim 1 further including second fastener means adjacent the upper end of said strap for releasably securing said strap to said footwear.

3. The footwear of claim 1 wherein the outer surface of said strap is provided with decorative features.

4. The footwear of claim 1 wherein said wire loop comprises a generally arcuate wire bail with opposite ends sized to extend within the welt area around the heel and elastic retaining means extending between the opposite ends of said bail.

5. The footwear of claim 1 wherein said strap defines an aperture to accept a projection extending from the outside counter area of the boot.

6. The footwear of claim 1 wherein said strap is leather.

* * * * *